US005894755A

United States Patent [19]

Seeber et al.

[11] Patent Number: 5,894,755

[45] Date of Patent: Apr. 20, 1999

[54] FORGING MACHINE

[75] Inventors: Alfred Seeber, Garsten/Steyr; Rupert Wieser, Seitenstetten, both of Austria

[73] Assignee: GFM Holding Aktiengesellschaft, Steyr, Austria

[21] Appl. No.: 08/931,641

[22] Filed: Sep. 16, 1997

[30] Foreign Application Priority Data

Sep. 17, 1996 [AT] Austria ..... 1639/96

[51] Int. Cl.[6] ..... B21J 9/18

[52] U.S. Cl. ..... 72/441; 72/402; 72/446; 100/257

[58] Field of Search ..... 72/402, 452.5, 72/453.03, 453.04, 446, 441; 100/257

[56] References Cited

U.S. PATENT DOCUMENTS

| | | | |
|---|---|---|---|
| 3,572,077 | 3/1971 | Kralowetz | 72/402 |
| 3,837,209 | 9/1974 | Guse | 72/402 |
| 3,841,125 | 10/1974 | Guse | 72/402 |
| 4,148,209 | 4/1979 | Bessho | 72/453.03 |
| 4,905,495 | 3/1990 | Pahnke | 72/402 |
| 5,609,056 | 3/1997 | Seeber | 100/257 |

FOREIGN PATENT DOCUMENTS

| | | | |
|---|---|---|---|
| 0 236 589 | 9/1987 | European Pat. Off. . | |
| 0 667 197 | 8/1995 | European Pat. Off. . | |
| 1243950 | 7/1967 | Germany | 72/402 |
| 1 908 362 | 9/1970 | Germany . | |
| 2159461 | 6/1973 | Germany | 72/402 |
| 2507301 | 10/1975 | Germany | 72/402 |
| 0889253 | 12/1981 | U.S.S.R. | 72/402 |

*Primary Examiner*—David Jones
*Attorney, Agent, or Firm*—Collard & Roe, P.C.

[57] ABSTRACT

A forging machine (1) comprises at least two forging punches (5) acting against each other and longitudinally guided in a machine frame (2), which each have separate stroke drives (9) and stroke position adjusting means (10). To make the forging machine (1) suitable for a large forging range with a simple design, each forging punch (5) together with longitudinal guideway (8) and stroke position adjusting means (10) and the associated stroke drive (9) are combined to a forging unit (3) and disposed in a separate housing (7), which is pivotally or movably mounted in the machine frame (2) and for adjustment is supported on an actuator (11).

10 Claims, 3 Drawing Sheets

FORGING MACHINE

BACKGROUND OF THE INVENTION

1. Field of the Invention

This invention relates to a forging machine comprising two forging punches acting against each other and longitudinally guided in a machine frame, which forging punches each have separate stroke drives and stroke position adjusting means.

2. Description of the Prior Art

To increase the forging range of a forging machine while maintaining a tool set, and to be able to use relatively simple forging tools with a long service life, it has already been proposed to employ radial forging machines with intermeshing hammers, for which purpose, however, the tools mounted at the end face on the four forging punches acting against each other must be adjusted transverse to the effective direction in the forging plane, so that they do not hit each other during forging, but can move past each other and can comprehensively forge the cross-section of the forging material. To this end, as shown in DE 1,908,362 A or EP 0,236,589 A, the forging punches are swivelled about an axis parallel to the forging axis during the working stroke, so that the forging force applied by means of a fixedly mounted or likewise pivotally supported hydraulic stroke drive can be transferred via a joint or the like, and in addition a rolling movement is forcedly superimposed on the pure stroke movement.

In addition, there are also radial forging machines, which have forging punches with transversely movable forging tools, so that there is no swivel movement of the forging punches, but the transverse adjustment of the tool is susceptible to failure and wear as a result of its location in the vicinity of the scale of the forging material. The transverse movement of the hammers is effected only during idling, and there cannot be achieved a rolling effect, even if it is possibly desired.

SUMMARY OF THE INVENTION

It is therefore the object underlying the invention to create a forging machine as described above, which with a comparatively inexpensive, compact and robust design is characterized by its high adaptability to all kinds of forging tasks.

This object is solved by the invention in that each forging punch together with longitudinal guideway and stroke position adjusting means and the associated stroke drive are combined to one forging unit and are accommodated in a separated housing, which is pivotally or movably mounted in the machine frame and for swivelling or moving the same is supported on an actuator. These forging units provide for an economic production of the forging machine due to the incorporation of the prefabricated units in a rather simple machine frame, and the separate stroke drives of the forging units can easily be operated in synchronism by expediently providing common drive means comprising drive connections and motors. In addition, the adaptability of the forging units provides for the adaptation of the forging machine to a large range of forging, where inside each forging unit there is a short, direct flux of force during the forging operation, as a pivotal connection between drive and forging punch is not necessary. The adjustment of the forging units can be utilized for either specifically defining a certain setting of the forging tool or the forging direction, or to superimpose a certain transverse movement on the forging stroke of the punch, so as to achieve for instance a controllable tangential rolling effect during forging, where the actuator accordingly swivels or moves the forging units between or during the forging strokes. Since in every forging unit the stroke drive and also the stroke position adjusting means are integrated for the associated forging punch, certain changes in the stroke frequency, the stroke sequence and of course also in the stroke position may be performed depending on the forging method, which provides for the execution of all kinds of forging operations and methods. With one tool set and with a rotating or non-rotating workpiece it is thus possible to forge one after the other a round cross-section or an angular cross-section of different reduction, and forging with radially aligned tools or radially offset intermeshing tools is of course also possible.

Depending on the forging task, the swivel axis or the direction of movement of the housing can extend vertical or parallel or at an angle to the forging axis, so that for instance with a vertical extension of the axis or a parallel extension of the direction a milling or an adaptation of the forging movement to continuous clamping head movements and the like can be achieved. An extension at an angle in turn provides for an adaptation of the punch movement to a flow movement or a rotary movement of the workpiece. But when the swivel axis or the direction of movement of the housing extends parallel or vertical to the forging axis, the punch movement can not only be adjusted to a rotary movement of the workpiece, but by means of appropriate setting angles or paths of movement forging can also be effected with intermeshing hammers under perfect forging conditions and/or a deliberate tangential rolling effect can also be produced.

When the swivel axis of the housing coincides with the axis of a drive shaft of the stroke drive, favorable power transmission and supporting conditions are obtained with a simple design. For supporting the drive shaft in the housing and for supporting the housing in the machine frame common bearing bushes may be used, which on their inside accommodate the eccentric shaft and on their outside are mounted in appropriate bearing points of the wall plates of the machine frame.

A particularly expedient construction of the invention is obtained when an eccentric shaft with a sliding pad rotatably mounted on the eccentric is provided as drive shaft, which sliding pad mechanically cooperates with the forging punch constituting a connecting rod, where the forging punch consists of two parts, an upper part on the side of the sliding pad and a lower part on the side of the tool, which lower part is axially movable relative to the upper part via the stroke position adjusting means. In this case, an eccentric-driven forging connecting rod with all its advantages can be utilized for the forging unit, where for the connection between sliding pad and forging punch a usual positive connection by means of a connecting link guide, but also a purely frictional connection, as it is illustrated for instance in the EP 0,667,197 A, are chosen. There is obtained a very compact, space-saving design of the stroke drive, which is optimally suited for being accommodated in the housing of the forging unit. For adjusting the stroke position, the two parts of the punch need merely be adjusted relative to each other, which can be achieved in various ways.

A purely mechanical construction is obtained when the lower part nonrotatably guided in the housing is mounted in a screw connection with the upper part rotatably guided in the housing, and the stroke position adjusting mean comprises a rotary drive associated to the upper part, which rotary drive comprises a transmission with a gear rim nonrotatably, but axially movably mounted on the upper part and rotatably, but axially immovably mounted in the housing, so that a screw connection of upper and lower part involves an adjustment of the stroke position also during the forging operation.

A hydromechanical solution is obtained in that for the frictional connection of upper part and lower part the lower part can be urged against the upper part by means of a pressure spring by interposing a hydraulic pad, and the hydraulic pad is in line connection with a hydraulic fluid supply means as stroke position adjusting means. By means of the volume of the hydraulic pad the axial distance between upper part and lower part can be influenced, and thus the required adjustment of the stroke position can be performed. The direct attachment of the supply means at the housing provides for extremely short line connections, and simple hydraulic systems may be used. In addition, the pressure spring, in particular a hydraulic pressure spring, can at the same time provide for a corresponding frictional connection between upper part and lower part and possibly between upper part and sliding pad.

To achieve a particularly expedient design, upper part and lower part of the forging punch coaxially engage from both sides in a cylinder inserted in the housing, and the hydraulic pad is formed inside the cylinder between upper part and lower part. On a minimum of space there is thus formed a forging unit with hydraulic stroke position adjusting means, which in addition to the adjustment of the stroke position also provides for mounting a simple overload protection by means of overload valves and the like for the hydraulic pad.

BRIEF DESCRIPTION OF THE DRAWING

In the drawing, the subject-matter of the invention is represented by way of example, wherein.

DETAILED DESCRIPTION OF PREFERRED EMBODIMENTS

Figure 1:
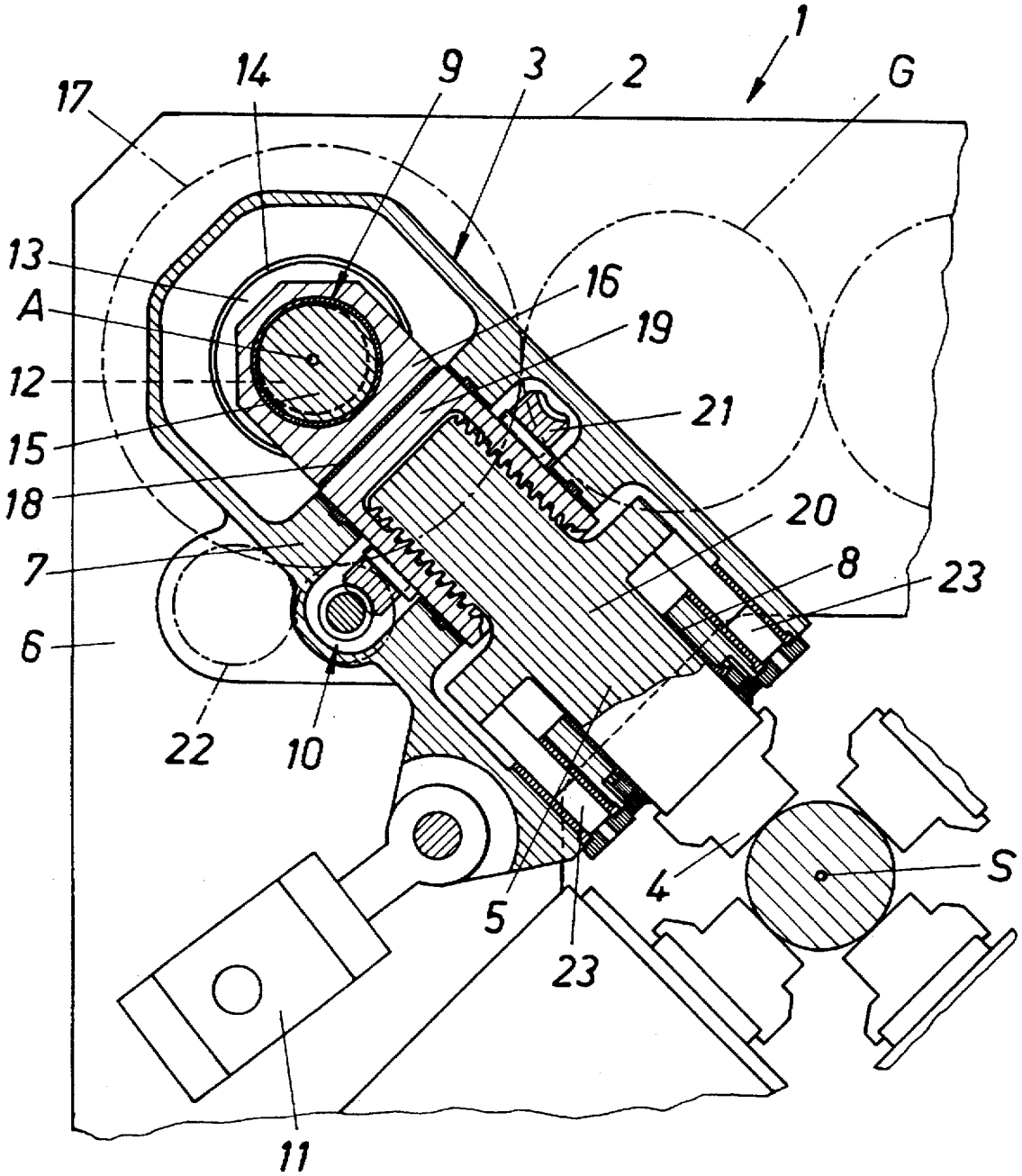
FIG. 1 and 2 represent a part of an inventive forging machine in a schematic cross-section and in an axial section, respectively.

A forging machine 1 comprises four forging units 3 inserted in a machine frame 2 with forging punches 5 acting against each other and carrying forging tools 4, where the forging units 3 are disposed between end wall plates 6 of the machine frame 2 with a 90° offset angle and define a common forging plane.

Each forging unit 3 consists of a housing 7, which has longitudinal guideways 8 for the forging punch 5, and in which in addition a stroke drive 9 associated to the forging punch 5 and a stroke position adjusting means 10 are accommodated. The housing 7 is pivotally mounted in the end wall plates 6 of the machine frame 2, and for swivelling is hinged at an actuator 11 likewise supported on the machine frame 2 in a manner not represented in detail. The swivel axis A of the housing 7 coincides with the axis of an eccentric shaft 12 of the stroke drive 9, so that the entire forging unit 3 and thus the forging punch 5 as well can be swivelled in its effective direction about the axis of the eccentric shaft, and the effective direction can thus be changed relative to the forging axis S, namely both for setting the effective direction for the forging operation and for superimposing a swivel movement on the forging stroke.

The eccentric shaft 12 of the stroke drive 9 is mounted in bearing bushes 13, which at the same time serve the support of the housing 7 and are inserted in the corresponding bearing points 14 of the end wall plates 6. On the eccentric 15 of the eccentric shaft 12 a sliding pad 16 is rotatably mounted, which provides for converting the rotary movement of the eccentric shaft into a stroke movement. The eccentric shaft 12 is connected with an only indicated drive gearwheel 17 accommodating a centrifugal mass, which for the synchronous rotary drive of all forging units is included in an only indicated common drive means G of the forging machine 1.

For adjusting the stroke position, the forging punch 5 comprises an upper part on the side of the sliding pad and a lower part on the side of the tool, where the lower part is axially adjustable relative to the upper part via the stroke position adjusting means 10.

Figure 2:
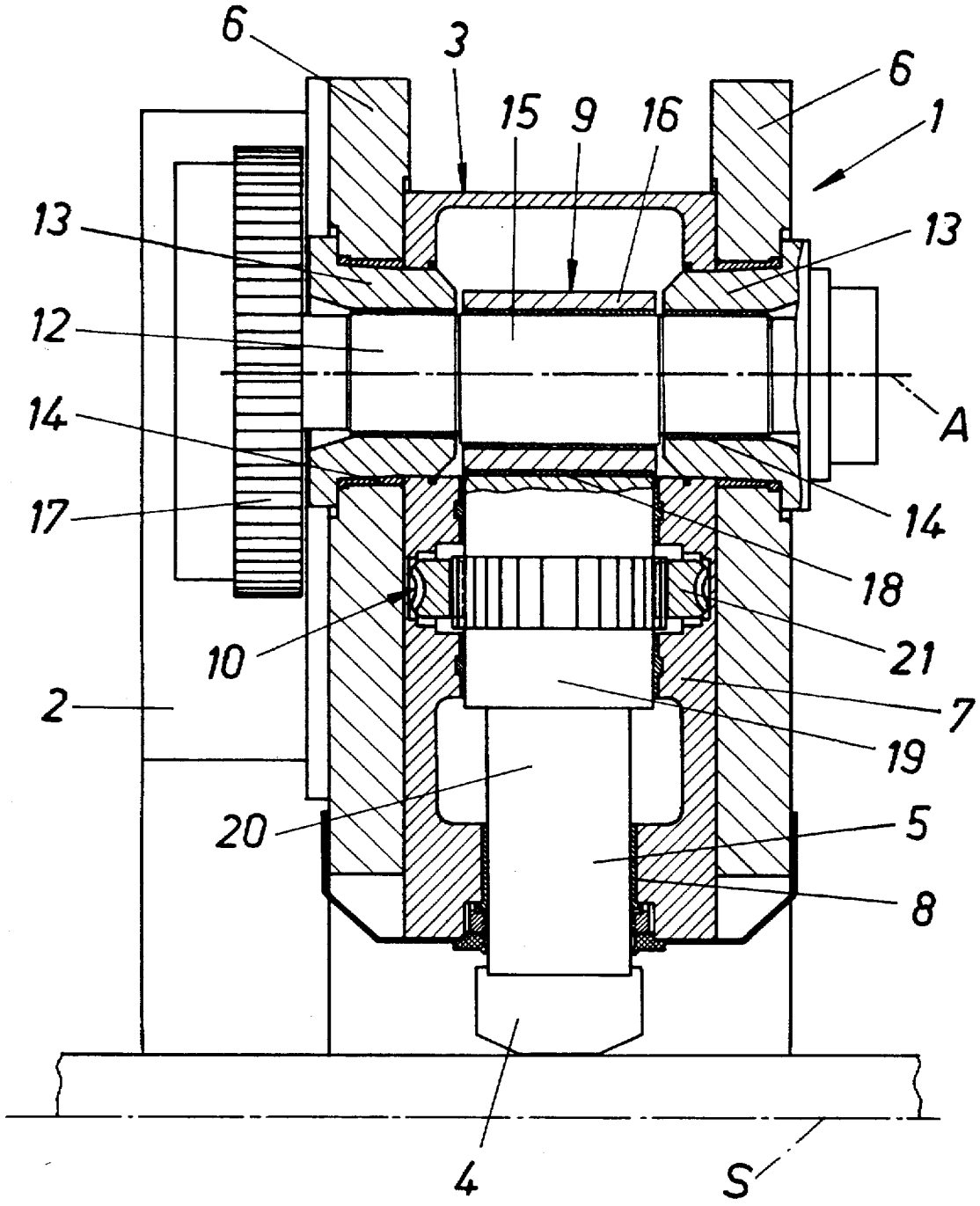

In accordance with the embodiment shown in FIG. 1 and 2 the forging punch 5 has an upper part 19, which with its end face 18 as sliding surface is in frictional engagement with the sliding pad 16, and a lower part 20 to be screwed into the upper part 19, where the upper part 19 is rotatably guided in the housing 7, and the lower part 20 is guided nonrotatably. The stroke position adjusting means 10 comprises a gear rim 21, which is nonrotatably, but movably mounted on the rotatable upper part 19 of the punch and is in drive connection with an actuator 22, so that a rotation of the gear rim 21 effects a stroke position adjustment of the lower part 20 caused by screwing. Pressure springs 23 act on the forging punch 5 opposite to the effective direction, so that the frictional connection between sliding pad 16 and punch 5 is ensured.

Figure 3:
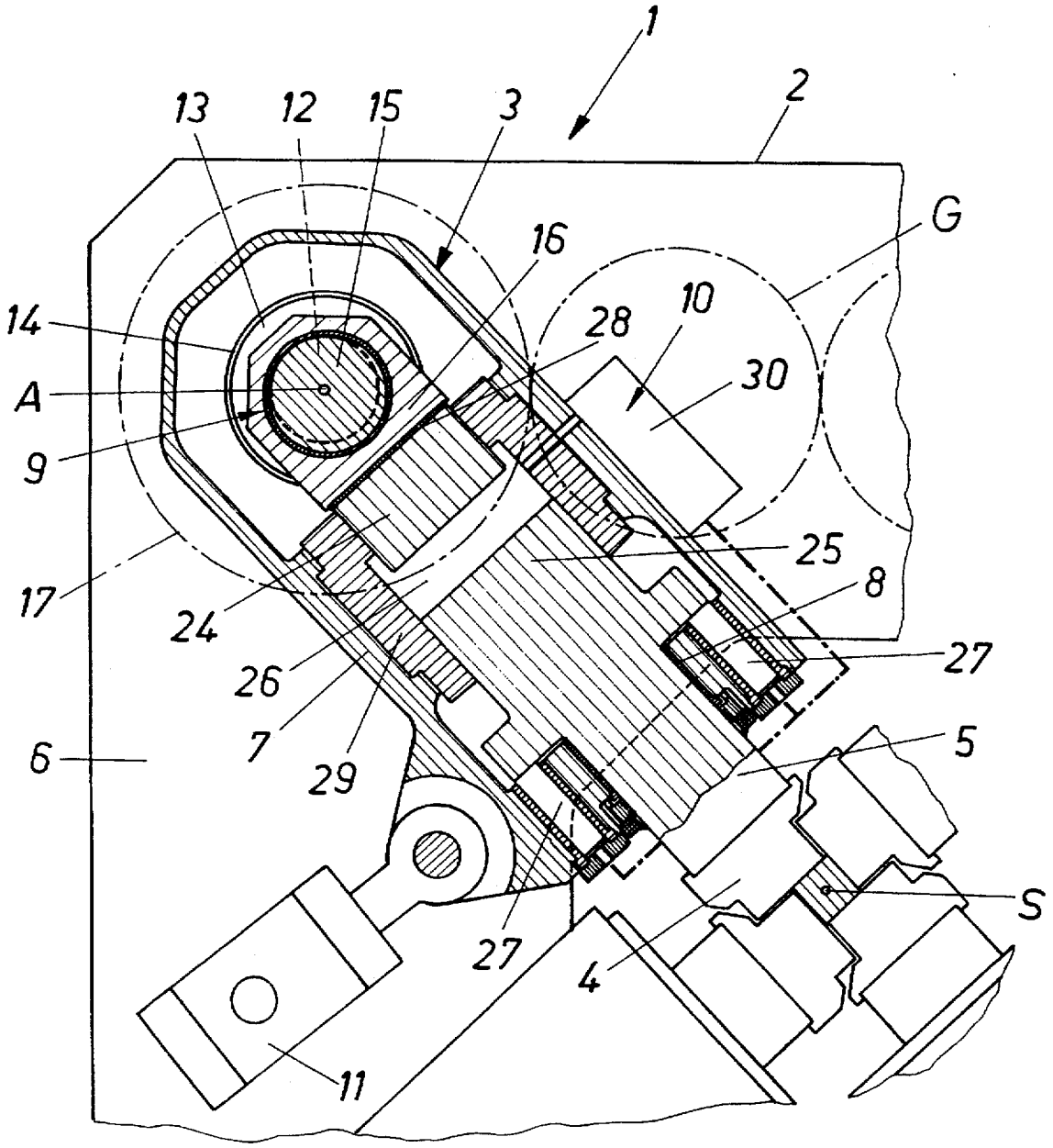
FIG. 3 represents another embodiment of an inventive forging machine, likewise in a schematic cross-section.

In accordance with the embodiment shown in FIG. 3, upper part 24 and lower part 25 of the forging punch 5 are frictionally connected with each other by interposing a hydraulic pad 26, where the lower part 25 is subjected to a pressure by a hydraulic pressure spring 27 opposite to the effective direction of the punch 5, so as to ensure on the one hand the frictional connection between the forging punch parts 24, 25 and on the other hand the frictional connection between the sliding pad 16 and the associated sliding surface 28 of the upper part 24. Upper part 24 and lower part 25 coaxially engage in a cylinder 29 inserted in the housing 7, so that in a constructively simple manner the hydraulic pad 26 is formed, and this hydraulic pad is in line connection with a hydraulic fluid supply means 30 as stroke position adjusting means 10, through which line connection the hydraulic pad 26 can be supplied with pressure fluid and the relative position of the lower part 25 with respect to the upper part 24 can be changed.

Independent of the type of stroke drive 9, the forging unit 3 can be swivelled about the swivel axis A by the actuator 11, so as to forge radially, as indicated in FIG. 1, or, as indicated in FIG. 3, provide for a radially offset forging with intermeshing forging tools 4 by a corresponding swivel movement of the forging punch 5, or also for superimposing a rolling movement on the forging stroke.

We claim:

1. A forging machine comprising (a) a machine frame, (b) at least two facing forging units wherebetween a forging axis extends, each forging unit comprising (1) a housing adjustably mounted in the machine frame for movement transversely to the forging axis, the housing encasing (2) a forging punch carrying a forging tool at an outer end thereof, (3) a longitudinal guideway in the housing for longitudinally guiding the forging punch, (4) a drive for imparting a stroke to the forging punch along the longitudinal guideway and perpendicularly to the forging axis, the strokes of the forging punches of the facing forging units extending in opposite directions, and (5) a stroke position adjusting means, and (c) an actuator connected to each forging unit for imparting said movement to the housing.

2. The forging machine of claim 1, wherein the housing is adjustably mounted in the machine frame for movement in a direction extending perpendicularly to the forging axis.

3. The forging machine of claim 1, wherein the housing is adjustably mounted in the machine frame for pivoting about a pivoting axis.

4. The forging machine of claim 3, wherein the pivoting axis extends parallel to the forging axis.

5. The forging machine of claim 3, wherein the drive for imparting a stroke to the forging punch comprises a drive shaft having an axis, and the drive shaft axis coincides with the pivoting axis of the housing.

6. The forging machine of claim 5, comprising common bearing bushes for the drive shaft in the housing and for the housing in the machine frame.

7. The forging machine of claim 5, wherein the drive shaft is a cam shaft having a cam and a sliding pad rotatably mounted on the cam, the sliding pad mechanically cooperating with the forging punch and driving the forging punch like a piston rod, and the forging punch being comprised of an upper part adjacent the sliding pad and a lower part adjacent the forging tool, the lower part being axially adjustable relative to the upper part by the stroke position adjusting means.

8. The forging machine of claim 7, wherein the upper part of the forging punch is rotatably guided in the housing and the lower part of the forging part is non-rotatably guided in the housing, the upper and lower parts being connected by a screw connection, and the stroke position adjusting means comprises a rotary drive for the upper forging punch part, the rotary drive comprising a transmission including a gear rim, the gear rim being mounted non-rotatably but axially movably on the upper forging punch part and rotatably but axially immovably in the housing.

9. The forging machine of claim 7, further comprising a pressure spring biasing the lower forging punch part against the upper forging punch part for connecting the upper and lower forging punch parts, and the stroke position adjusting means comprises a hydraulic cushion between the upper and lower forging punch parts and a hydraulic fluid supply means connected to the hydraulic pad.

10. The forging machine of claim 9, further comprising a cylinder, the upper and lower forging punch parts being coaxially inserted in the cylinder, and the hydraulic cushion being formed inside the cylinder between the upper and lower forging punch parts.

* * * * *